United States Patent [19]

Barnett

[11] 3,998,013

[45] Dec. 21, 1976

[54] COLLAPSIBLE MANSARD ROOF STRUCTURE FOR TRANSPORTABLE BUILDING

[75] Inventor: Norton C. Barnett, Elkhart, Ind.

[73] Assignee: Admiral Homes, Inc., Elkhart, Ind.

[22] Filed: Apr. 30, 1975

[21] Appl. No.: 573,020

[52] U.S. Cl. ..... 52/69; 52/68; 52/66

[51] Int. Cl.[2] ..... E04B 7/16

[58] Field of Search ..... 52/66, 68, 69, 70, 94, 52/95, 96

[56] References Cited

UNITED STATES PATENTS

| | | | |
|---|---|---|---|
| 2,572,363 | 10/1951 | Mayer | 52/77 |
| 2,890,498 | 6/1959 | Bigelow | 52/69 |
| 3,360,891 | 1/1968 | Gardner | 52/70 |
| 3,507,079 | 4/1970 | George | 52/92 |
| 3,612,589 | 10/1971 | Locher | 52/66 |
| 3,727,354 | 4/1973 | Powell | 52/641 |
| 3,744,196 | 7/1973 | Weese | 52/70 |
| 3,768,217 | 10/1973 | Tyson | 52/95 |
| 3,823,522 | 7/1974 | Juriet | 52/641 |

*Primary Examiner*—Price C. Faw, Jr.
*Assistant Examiner*—Henry Raduazo
*Attorney, Agent, or Firm*—Albert L. Jeffers; Roger M. Rickert

[57] ABSTRACT

A collapsible mansard roof structure for a transportable building, especially for a mobile home, in which the mansard roof structure includes panels along the upper portions of the side walls of the building hingedly connected at the upper edges to the building near the edges of the roof proper of the building. The panels making up the mansard roof structure can, thus, be pivoted downwardly against the sides of the building for transport, and when the building structure reaches the place of use thereof, the panels are tilted outwardly at the bottom and truss elements are interposed between the tilted out panels and the side walls of the building. The trusses are substantially triangular and are swingably connected to one of the building side wall and the underside of the panels so that they can be pivoted from positions parallel to the member to which they are connected into positions in which the truss elements are in planes perpendicular to the plane of the panel making up the respective mansard roof portion. Further, a bottom closure panel or soffit is pivotally suspended from the lower edge of the panels making up the mansard roof portions, and during transport, hangs vertically downwardly beneath the mansard roof, and when the panels making up the mansard roof sections are swung outwardly and the truss elements are set up therebetween, the trim panel or soffit are swung inwardly beneath the mansard roof sections and attached to the side wall of the building.

7 Claims, 5 Drawing Figures

COLLAPSIBLE MANSARD ROOF STRUCTURE FOR TRANSPORTABLE BUILDING

The present invention relates to transportable building structures, and is particularly concerned with a mobile home or the like, and especially to a collapsible mansard roof arrangement for such a transportable building.

Transportable buildings, especially in the form of mobile homes, are known and are manufactured at a manufacturing location and are then transported over the highways to a place of use. The transportable buildings are advantageously made up as large as possible in order to provide adequate space inside the buildings, but restrictive laws exist with regard to the lateral and longitudinal dimensions that such a building can have if it is to be transported over the highways.

A desirable feature for such a transportable building, especially for a mobile home, is a mansard roof structure, not only for the improved appearance which is imparted to the building structure but, also, for the purposes of shielding the windows and door openings and providing a heating and sound insulating effect, at least around the upper portion of the building.

Heretofore, it has not been possible to incorporate mansard type roof structures in buildings of the aforesaid nature unless the building was diminished in dimensions so that the overall dimensions of the structure fell within legally permissible limits for highway transport.

With the foregoing in mind, a primary objective of the present invention is the provision of a mansard type roof structure for a transportable building in which the inclined portions of the mansard roof structure depending from the side edges of the roof proper can be colapsed downwardly against the sides of the building for transporting the building on a highway.

Another objective is the provision of an arrangement of the nature referred to above in which the depending mansard roof sections can readily be erected at the place of use of the trailer and in a minimum of time and with a minimum of effort.

BRIEF SUMMARY OF THE INVENTION

According to the present invention, a transportable building structure, such as a mobile home, is provided with panels extending along the upper portions of the outer walls of the building structure and pivoted to the building structure at the upper edges of the panels and adapted to depend substantially vertically at the sides of the building structure during transport thereof.

Distributed beneath the aforementioned panels and the outer walls of the building are substantially triangular truss elements which are swingably connected to one of the underside of the panels and the outer wall of the building and which, during transport, are swung into a plane substantially parallel with the outer walls of the building structure thereby permitting the panels referred to depend substantially vertically at the sides of the building structure.

When the building structure or mobile home reaches a place of use, the panels making up the inclined sides of the mansard roof arrangement are pivoted outwardly at the bottom and the aforementioned truss elements are swung outwardly so as to be disposed in planes perpendicular to the planes of the panels and, also, to the planes of the outer walls of the building. The truss elements, in this last mentioned position, support the inclined mansard roof panels at the proper angle on the building structure.

Pivotally suspended from the lower edge of the mansard roof panels are soffit or trim panel means, and when the mansard roof panels are in erected position, the trim panel means are swung inwardly beneath the mansard roof and connected at the inner edge to the outer wall of the building or mobile home strucutre.

The building strucutre is provided with openings in the outer walls as for windows and doorways and the mansard roof is provided with cut outs extending upwardly therein from the bottom edge and registering with the openings in the side wall. The aforementioned truss elements include a truss element at each side edge of each cut out which is closed on the side facing the cut out so that when the mansard roof arrangement is erected, it is closed at the bottom and at each side edge of each of the aforementioned cut outs.

Normally, the mansard roof means at the hitch end of the building or mobile home structure can be rigidly mounted thereon because it projects toward a towing vehicle and presents no problems with respect to transporting the building structure or meeting legal requirements.

The panels making up the inclined mansard roof at the sides of the building structure and at the end opposite the hitch end, however, are pivotal downwardly against the outer walls of the building structure. The mansard roof arrangement when erected is continuous with the portions on the respective sides of the building abutting to form a closed joint and to accomplish this, at least one of the mansard roof sections at the end of the vehicle or the ends of the mansard roof sections on the sides of the vehicle adjacent the hitch end include a foldable or hinged panel which will close any space between adjacent mansard roof panels when the mansard roof is erected.

When the roof is erected, it can be calked and sealed to make it weather tight wherever necessary.

The exact nature of the present invention will become more clearly apparent upon reference to the following detailed specification taken in connection with the accompanying drawings in which.

Figures 1, 2:
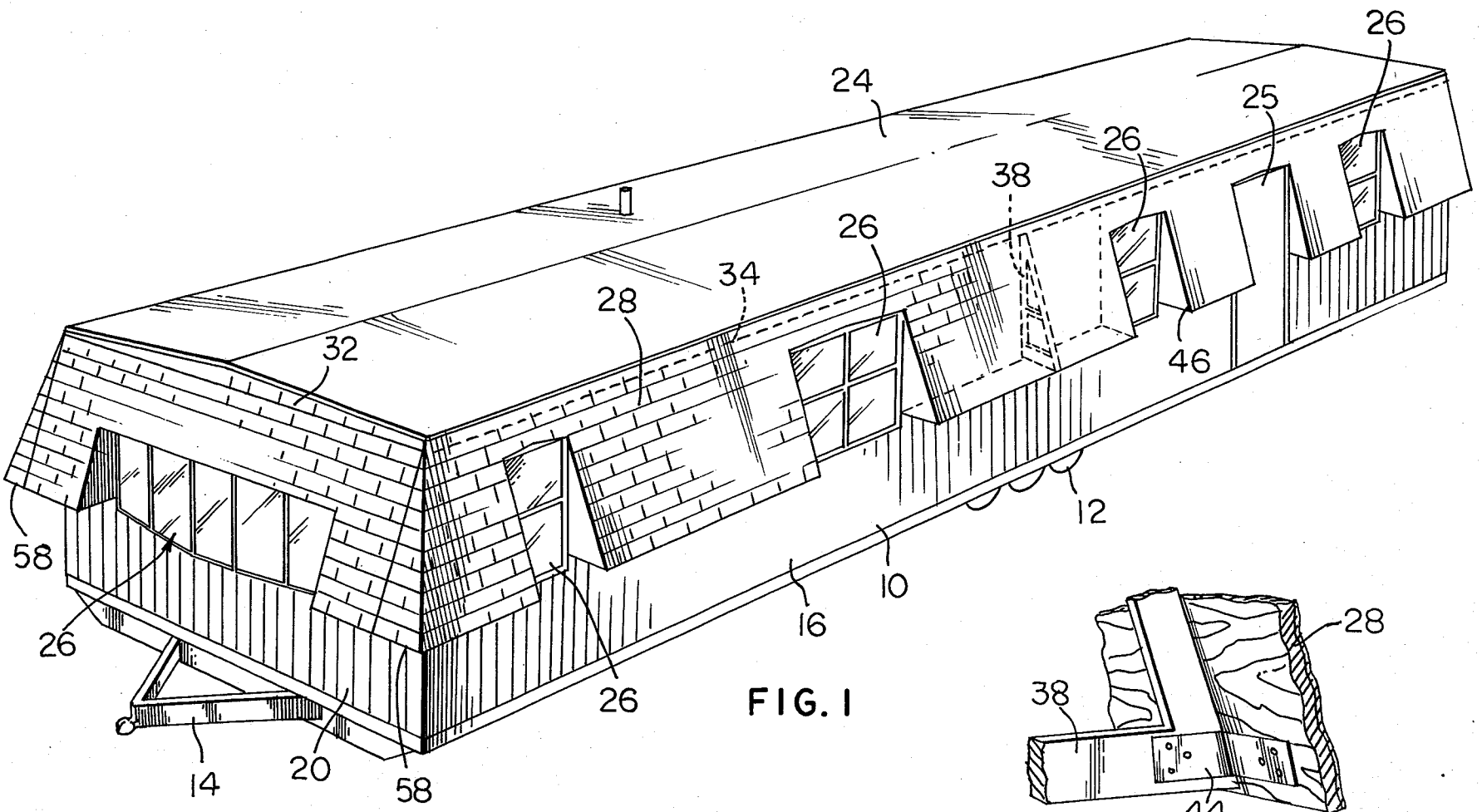
FIG. 1 is a perspective view looking in angularly at a mobile home from the hitch end and showing a mansard roof structure according to the present invention in erected position.
FIG. 2 is a fragmentary perspective view showing how a truss beneath the mansard roof could be swingably connected thereto as by a bendable metal strip.

DETAILED DESCRIPTION OF THE INVENTION:

Referring to the drawings somewhat more in detail, the transportable building shown therein at 10 is in the form of a mobile home having supporting wheels 12 connected thereto between the ends and a hitch structure 14 at one end of the building structure. The mobile home illustrated has a substantially vertical outer wall portion in the form of side walls 16 and 18 which are parallel, a forward wall 20 at the hitch end of the structure extending laterally between side walls 16 and 18 and a rearward wall 22 parallel to forward wall 20 and extending between walls 16 and 18 at the rearward end of the mobile home. The mobile home, furthermore, has a roof structure 24 which can be considered the roof proper.

The outer walls of the building structure or mobile home is provided with a plurality of openings 26 distributed thereabout for receiving windows and doors according to more or less conventional procedures.

According to the present invention, a mansard roof structure is provided for the mobile home and which consists of elongated side panels 28 extending along the upper portions of side walls 16 and 18, a panel 30 extending across the upper portion of rearward wall 22 and a panel 32 extending across the upper portion of forward wall 20. Panel 32 may be rigidly connected to the building structure, but panels 28 and 30 are pivotally connected at the upper edges to the building structure.

Figure 3:
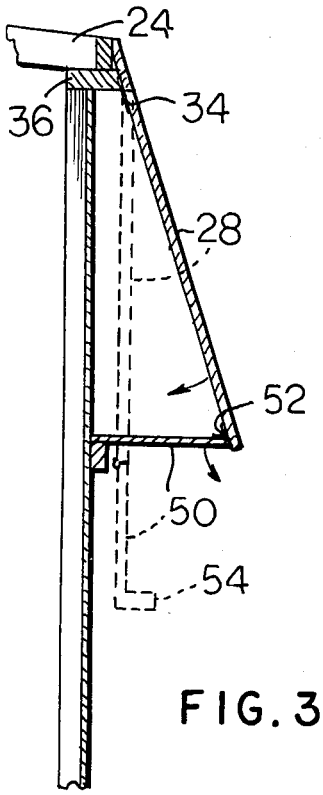
FIG. 3 is a schematic view showing in dashed lines how the mansard roof and the soffit panel depending therefrom hang vertically downwardly at the outside of the building structure before erection and showing in full lines the mansard roof panel and the soffit at the bottom as it appears when erected.
Figure 4:
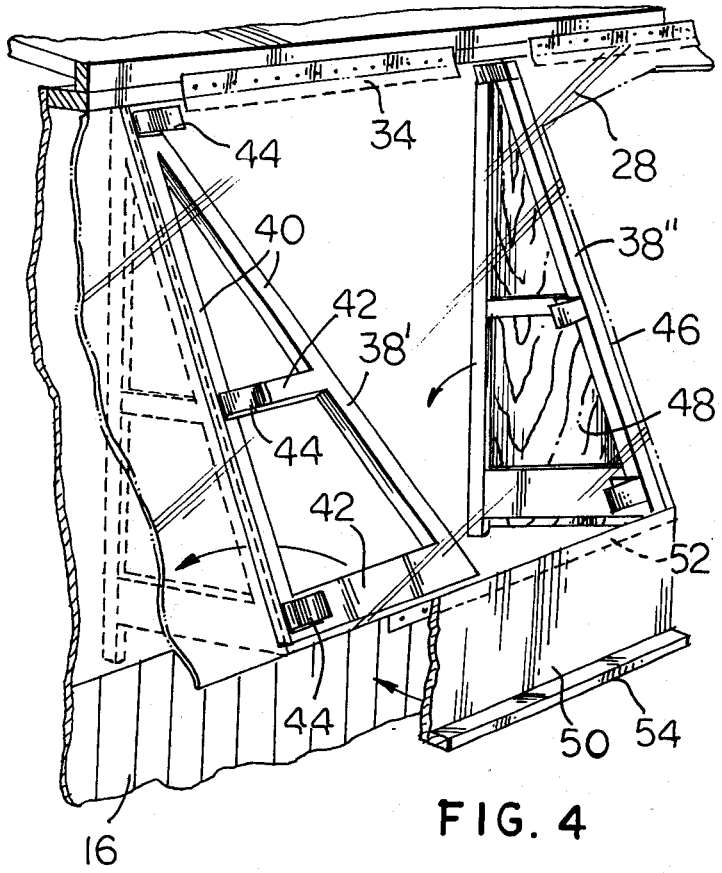
FIG. 4 is a schematic perspective view showing toward the right a truss in erected position and disposed at one side of a cut out in the respective mansard roof section while adjacent thereto is another truss element shown in the position which it occupies before being folded out into roof supporting position.

As will be seen in FIGS. 3 and 4, for example, a panel 28 may have a pivot, such as a flexible steel plate, at 34 connecting the upper edge of panel 28 to a still arrangement 36 at the edge of the roof 24 of the building structure. Because of the pivot at 34, the panel 28 can be dropped downwardly to its dotted line position in FIG. 3 so as to be disposed substantially entirely within the lateral confines of the building structure. The rearward panel 30 is similarly supported on the building structure and can also be lowered thereon to a position conforming to that shown for panel 28 in FIG. 3. In some instances these rearward panels 30 can be set up at the factory and left in the set up position, if the mobile home does not exceed the legal overall length for travel over the highways.

When the mansard roof panels are swung out to the erected position, as shown in full lines in FIG. 3, the roof panels are supported by truss elements distributed therealong. One such truss element is identified in dotted lines at 38 in FIG. 1. Each truss element is made up of side rails 40 converging in the upward direction with interconnecting lateral rails 42. Each truss element, as will be seen in FIGS. 1 and 4, thus, forms a substantially triangular supporting device.

The truss elements are swingably disposed between the mansard roof panels and the respective outer wall of the building and are swingably connected to one thereof. In FIG. 4, for example, the truss element identified at 38′ has strips of bendable metal at 44 which connect the truss element with the underside of the respective mansard roof panel.

The metal strips 44 are bendable so that the truss element can be swung from a position in a plane parallel to the plane of the mansard roof panel into a plane which is perpendicular to the plane of the mansard roof panel as shown in dashed lines in FIG. 4 so as to be in supporting position relative to the roof panel.

The truss element indicated at 38″ is illustrated in erected position, whereas the truss element indicated at 38′ is indicated in folded up position.

The truss element 38″ is disposed at a side edge of a cut out 46 formed into the respective mansard roof panel from the lower edge thereof and registering with a respective side wall opening 26. The truss element 38′ includes a closure panel 48, of plywood, metal or fiberboard on that side thereof which faces the cut out when the truss element is in erected position. The truss element at each side of each cut out is similarly constructed so that when the mansard roof is erected, a closure is provided at each side of each of the cut outs 46 in the mansard roof panels.

In places along the mansard roof panel where a substantial distance exists between adjacent ones of the cut outs, truss elements, such as is shown in 38′ in FIG. 4 and at 38 in FIG. 1 can be provided. These truss elements do not have closure panels thereon.

Figure 5:
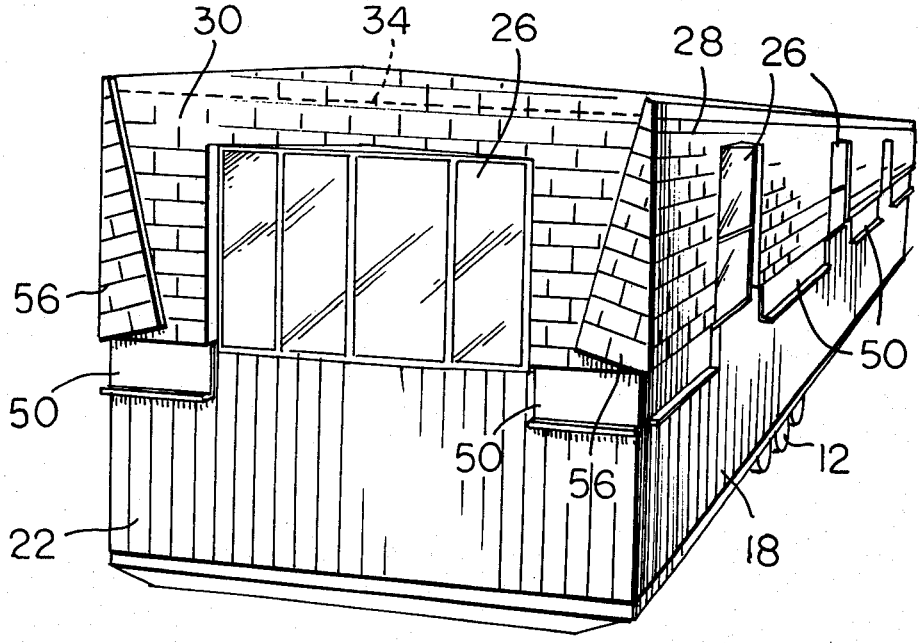
FIG. 5 is a perspective view looking in from a corner of the mobile home opposite the hitch end thereof and showing the mansard roof in collapsed position for transport.

Trim panels or soffits are provided on the lower edge of each tiltable mansard panel and extending from each cut out in the respective mansard panel to the next. The trim panels or soffits are indicated at 50 in FIGS. 3, 4 and 5 and are connected to the respective mansard panels as by piano hinges 52. As mentioned before, when the mansard roof panels are in collapsed position, the trim panels or soffits hang vertically downwardly beneath the mansard roof panels, but when the mansard roof panels are erected, trim panels 50 are swung inwardly underneath the mansard roof sections and are connected to the respective outer walls of the building structure.

As illustrated in the drawings, a cleat 54 is connected to the free edge of each closure panel, and when the closure panel is swung upwardly into horizontal position, the cleats can readily be nailed to studding located in the walls of the building structure. The panels can also be secured to the lower ends of the truss elements if so desired.

At the rearward ends of the side panels 28 of the mansard roof arrangement, there are disposed triangular panel elements 56 extending inwardly toward one another and providing elements which abut the adjacent edges of rearward mansard panel 30 when the mansard roof is erected so as to close the mansard roof in the peripheral direction.

For the forward end of the mobile home, similar triangular sections 58 are provided on the forward ends of side panels 28 or on the lateral ends of forward nonswingable mansard roof panels 32. In either case, the triangular sections 58 are swingable into the position illustrated in FIG. 1 thereby closing the mansard roof arrangement peripherally at the forward hitch or rearward end of the mobile home when the mansard roof arrangement is erected.

The arrangement according to the present invention is relatively inexpensive, especially since the arrangement permits the mansard roof structure to be constructed at the factory, thereby requiring no more than simple erected procedures when the building reaches the place of use.

Once the building structure or unit is installed in accordance with accepted set up procedures, the mansard structure, which has been fixed in place for shipment, is released and the section at the rearward end is first erected and thereafter the other sections around the building structure are erected. The truss elements are factory located so as to rest directly on a side wall stud wherever possible.

After the mansard roof has been erected, the panels are interconnected at the junctures thereof. The panels are previously provided with shingle arrangements which will close the juncture automatically when the roof is erected.

The soffit or trim panel sections are then lifted up to horizontal positions beneath the mansard and are secured to the outer wall as by nailing the cleat thereon to studs located in the building side wall.

The mansard is now calked and sealed where necessary to make it weather tight.

It will be understood that a reverse procedure could be carried out should it be desired to move the building structure to another location requiring transporting the building structure over a highway.

Modifications may be made within the scope of the appended claims.

What is claimed is:

1. In a transportable building having outer walls and a roof; mansard means extending along the upper portion of the outer walls, hinge means for pivotally connecting the upper edge region of the mansard means to the building near the outer edge of the roof, and truss means hingedly connected to the side of the mansard means facing the outer walls and having a folded in position substantially parallel to the plane of the mansard means and having a folded out position perpendicular to the plane of the mansard means to support the mansard means on the outer walls in erected outwardly inclined position, said outer walls of the building including parallel side walls and a rear wall and a front wall connecting the rearward and forward ends respectively of the side walls, said mansard means comprising portions which include means for the hinged connection of the upper edges to the building near the side and rearward edges of the roof, and a mansard roof section extending across the upper portion of the front wall of the building and non-hingedly connected thereto.

2. A transportable building according to claim 1 wherein a triangular section is positioned between the mansard roof section and mansard means when the mansard means is in erected position.

3. A transportable building according to claim 1 in which the outer walls include openings formed therein including window openings and extending into the vertical range of said mansard means, said mansard means including cut out regions extending therein from the lower edge thereof which register with the openings in the outer walls, said truss means including a truss element which is disposed at each side edge of a said cut out region in folded out position of the truss means.

4. A transportable building according to claim 1 in which said mansard means includes bottom trim panel means hingedly connected to the lower edge thereof and dependent from the mansard means in downwardly hinged position of the mansard means, said trim panel means being swingable inwardly to beneath said truss means when the mansard means is in erected position, and securing means for securing said trim panel means in the inwardly swung position thereof.

5. A transportable building according to claim 4 in which securing means includes cleat means extending along the lower edge of said trim panel means and engaging the outer walls of the building in erected position of said mansard means, said cleat means adapted for connection to the outer walls and closing the opening at the bottom of the erected mansard means.

6. A transportable building according to claim 1 in which the outer walls include openings formed therein including window openings and extending into the vertical range of said mansard means, said mansard means including cut out regions extending therein from the lower edge thereof which register with the openings in the outer walls, said truss means including truss elements which are disposed at each side edge of said cut out regions when the truss means are in erected position, said truss elements being closed on the sides which face the respective cut out regions when the truss elements are folded out in erected position of said mansard means, said truss means including further truss elements disposed between said mansard means and the building outer walls in the longitudinal region of said mansard means between at least some of said cut out regions thereof.

7. A transportable building according to claim 4 which includes a pivot plate at the lower edge of the mansard means and connecting the bottom trim panel means to the lower edge of the mansard means, and metal strips connecting the truss means to the underside of the mansard means and bendable to permit movement of the truss means between the two operative positions thereof.

* * * * *

UNITED STATES PATENT AND TRADEMARK OFFICE

CERTIFICATE OF CORRECTION

PATENT NO. : 3,998,013

DATED : December 21, 1976

INVENTOR(S) : Norton C. Barnett

It is certified that error appears in the above-identified patent and that said Letters Patent are hereby corrected as shown below:

Assignee is shown as ADMIRAL HOMES, INC.
It should be ADMIRATION HOMES, INC.

Signed and Sealed this

Fifth Day of April 1977

[SEAL]

*Attest:*

RUTH C. MASON
*Attesting Officer*

C. MARSHALL DANN
*Commissioner of Patents and Trademarks*